US007612720B2

(12) United States Patent
Kerselaers

(10) Patent No.: US 7,612,720 B2
(45) Date of Patent: Nov. 3, 2009

(54) WIRELESS LINK MODULE COMPRISING TWO ANTENNAS

(75) Inventor: Anthony Kerselaers, Herstelt (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 42 days.

(21) Appl. No.: 11/912,311

(22) PCT Filed: Apr. 19, 2006

(86) PCT No.: PCT/IB2006/051204

§ 371 (c)(1),
(2), (4) Date: Oct. 23, 2007

(87) PCT Pub. No.: WO2006/114724

PCT Pub. Date: Nov. 2, 2006

(65) Prior Publication Data

US 2008/0180342 A1 Jul. 31, 2008

(30) Foreign Application Priority Data

Apr. 25, 2005 (EP) ..... 05103313

(51) Int. Cl.
*H01Q 1/38* (2006.01)
*H01Q 9/28* (2006.01)
*H01Q 21/00* (2006.01)

(52) U.S. Cl. ..... 343/700 MS; 343/795; 343/893

(58) Field of Classification Search ..... 343/793, 343/797, 810–820, 846, 700 MS, 702, 795, 343/893

See application file for complete search history.

(56) References Cited

U.S. PATENT DOCUMENTS

| | | | | |
|---|---|---|---|---|
| 5,173,711 | A | 12/1992 | Takeuchi et al. | |
| 5,754,145 | A | 5/1998 | Evans | |
| 6,424,309 | B1 | 7/2002 | Johnston et al. | |
| 6,621,464 | B1 * | 9/2003 | Fang et al. | 343/795 |
| 6,950,065 | B2 * | 9/2005 | Ying et al. | 343/700 MS |
| 2004/0012534 | A1 | 1/2004 | Dai et al. | |
| 2004/0036659 | A1 | 2/2004 | Langley et al. | |
| 2004/0174301 | A1 | 9/2004 | Aisenbrey | |
| 2005/0035919 | A1 | 2/2005 | Yang et al. | |
| 2005/0040995 | A1 | 2/2005 | Huan | |

FOREIGN PATENT DOCUMENTS

| | | | |
|---|---|---|---|
| EP | 0777295 | A2 | 6/1997 |
| EP | 1414109 | A2 | 4/2004 |
| JP | 2004015246 | A | 1/2004 |
| WO | WO2004097981 | A1 | 11/2004 |

* cited by examiner

*Primary Examiner*—Shih-Chao Chen

(57) ABSTRACT

A wireless link module includes a lower band antenna and a higher band antenna. Each of these antennas includes an antenna element with a feeding end and an open end. The respective antenna elements are substantially capacitively coupled. In addition, the respective antenna elements are electrically coupled at the respective feeding ends via an antenna coupling short.

13 Claims, 3 Drawing Sheets

WIRELESS LINK MODULE COMPRISING TWO ANTENNAS

An aspect of the invention relates to a wireless link module that comprises a lower band antenna and a higher band antenna. The wireless link module may be used, for example, to establish a wireless link in accordance with the IEEE802.11a/b/g standard, which is commonly designated by the term "WiFi". Other aspects of the invention relate to a data communication apparatus, an information-rendering apparatus, and a wireless communication system. The data communication apparatus may be, for example, a data acquisition device that comprises an image capturing module, such as, for example, an X-ray detector. The information-rendering apparatus may be, for example, a personal computer or a video projector.

European patent application published under number 1 414 109 describes a dual band single feed dipole antenna. The antenna comprises a conventional single band dipole antenna, which is a half wave dipole antenna. Two open circuit stubs or arms load the single band dipole antenna. The two open circuit stubs form a second half wave dipole that resonates at a second frequency.

According to an aspect of the invention, a wireless link module comprises a lower band antenna and a higher band antenna. Each of these antennas comprises an antenna element with a feeding end and an open end. The respective antenna elements are substantially capacitively coupled. In addition, the respective antenna elements are electrically coupled at the respective feeding ends via an antenna coupling short.

The invention takes the following aspects into consideration. A wireless link module that can operate in two different frequency bands allows greater flexibility and often a better performance. A lower frequency band is generally more power efficient than a higher frequency band. Consequently, the lower frequency band generally allows data communication over a greater distance. However, as a result, there is a greater risk of interference due to other data communications in the lower frequency band. What is more, the lower frequency band generally comprises fewer channels than the higher frequency band, which contributes to this risk. It is therefore desirable that the wireless link module can be made to operate in the lower or higher frequency band depending on a particular context.

In many applications, the wireless link module needs to establish wireless link in a direction that is generally not known beforehand. Moreover, the direction may change throughout a communication session. Let it be assumed that the wireless link module has a directional radiation pattern instead of an omnidirectional radiation pattern. In many cases, a user would need to turn the wireless link module, or the apparatus of which it forms part, so as to establish a reliable wireless link. This can be quite cumbersome especially if the direction changes due to movement. The aforementioned prior art antenna has a directional radiation pattern and, as a result, suffers from these problems.

In accordance with the aforementioned aspect of the invention, a lower band antenna and a higher band antenna each comprise an antenna element with a feeding end and an open end. The respective antenna elements are substantially capacitively coupled. In addition, the respective antenna elements are electrically coupled at the respective feeding ends via an antenna coupling short.

Such a wireless link module provides an omnidirectional radiation pattern in a lower frequency band and a higher frequency band. Consequently, the invention allows greater user convenience and a relatively reliable, stable wireless link.

Another advantage of the invention relates to the following aspects. The wireless link module provides some antenna gain in the higher frequency band. It has been mentioned hereinbefore that the higher frequency band is generally less power efficient than the lower frequency band. The antenna gain in the high frequency band compensates for this. Consequently, the invention allows relatively power efficient implementations.

Yet another advantage of the invention relates to the following aspects. The respective antenna elements, which are substantially capacitively coupled, can be relatively close to each other. Indeed, the closer the respective antenna elements are, the stronger the capacitive coupling will be, which contributes to a satisfactory radiation pattern. The invention therefore allows relatively compact implementations that, nonetheless, provide a satisfactory radiation pattern.

These and other aspects of the invention will be described in greater detail hereinafter with reference to drawings.

Figure 1:
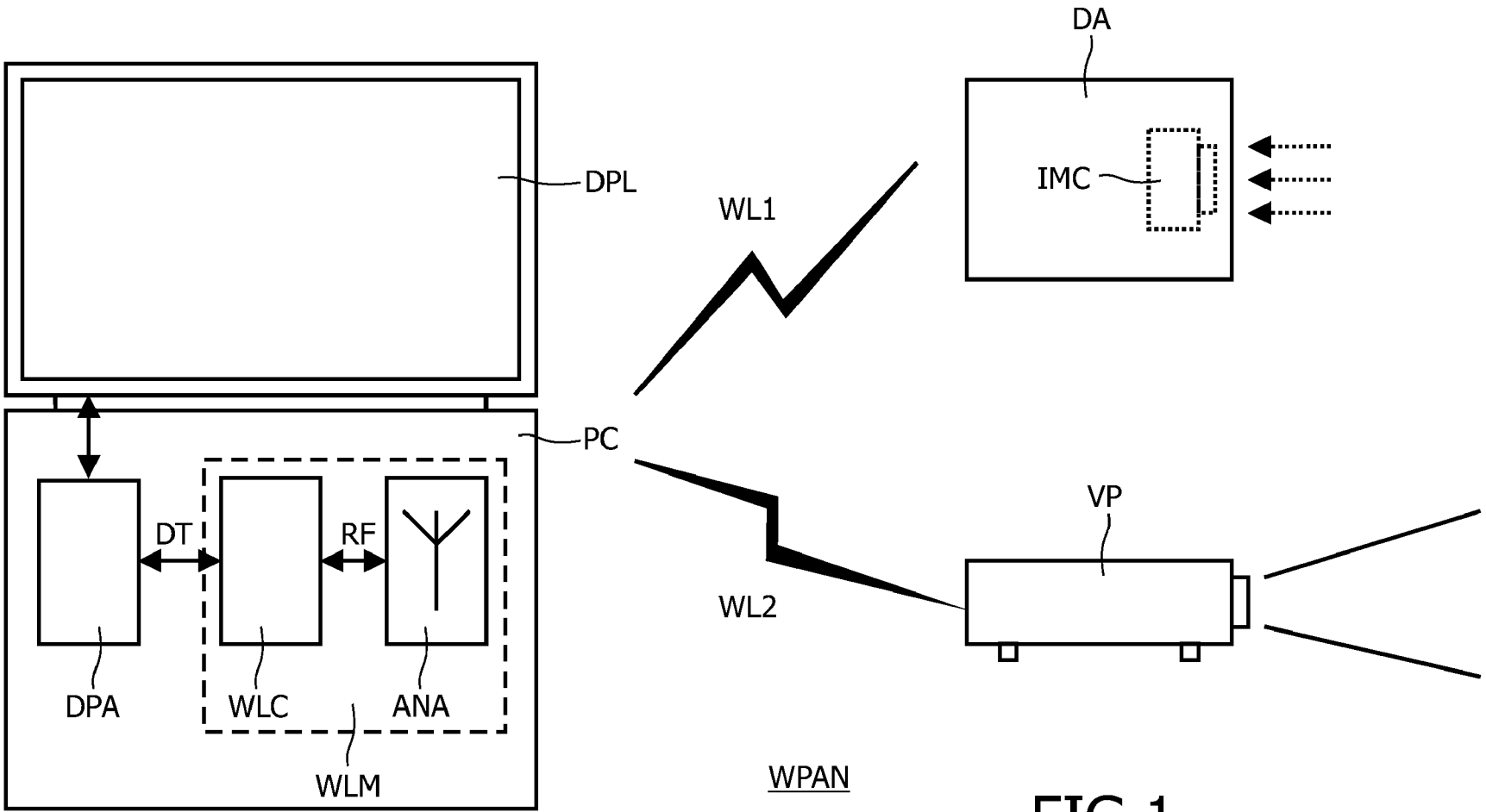
FIG. 1 is a block diagram that illustrates a wireless personal area network.

FIG. 1 illustrates a wireless personal-area network WPAN. The wireless personal-area network WPAN comprises a personal computer PC, a data acquisition apparatus DA, and a video projector VP. The personal computer PC comprises a display device DPL, a data-processing arrangement DPA, and a wireless link module WLM. The data acquisition apparatus DA may comprise, for example, an image capturing module EMC, which FIG. 1 illustrates in dotted lines. Accordingly, the data acquisition apparatus DA may provide data that represents an image, which the image capturing module EMC has captured. The data acquisition apparatus DA may be, for example, a portable X-ray detector.

The wireless link module WLM of the personal computer PC comprises a wireless link circuit WLC and an antenna assembly ANA. The wireless link module WLM may operate in reception mode and in a transmission mode.

In the reception mode, the antenna assembly ANA provides a radiofrequency signal RF in response to an electromagnetic field that conveys data DT. The wireless link circuit WLC derives the data DT from the radiofrequency signal RF and applies the data DT to the data-processing arrangement DPA.

In the transmission mode, the wireless link circuit WLC provides a radiofrequency signal RF on the basis of data DT, which the wireless link circuit WLC receives from the data-processing arrangement DPA. The antenna assembly ANA generates an electromagnetic field in response to the radiofrequency signal RF, which the wireless link circuit WLC provides. The electromagnetic field conveys the data DT from the data-processing arrangement DPA.

The video projector VP and the data acquisition apparatus DA each comprise a wireless link module comparable with the wireless link module WLM of the personal computer PC. Consequently, the video projector VP and the data acquisition apparatus DA each comprise an antenna assembly. It has been mentioned hereinbefore that the data acquisition apparatus DA may be a portable X-ray detector. In that case, the antenna assembly may be integrated into a plastic grip of the portable X-ray detector. The plastic grip may be fixed to a metal housing, which may comprise, for example, the image capturing module IMC and other circuits.

The personal computer PC can establish a wireless link WL1 with the data acquisition apparatus DA and a further wireless link WL2 with the video projector VP. The wireless links WL1 and WL2 may be in accordance with, for example, the IEEE802.11a/b/g standard, which is commonly designated by the term "WiFi".

The wireless links WL1 and WL2 allow the personal computer PC to exchange data with the data acquisition apparatus DA and with the video projector VP, respectively. For example, the personal computer PC may receive data from the data acquisition apparatus DA via the wireless link WL1. As mentioned hereinbefore, this data may represent an image to be displayed. The data-processing arrangement DPA, which receives the data via the wireless link module WLM, causes the display device DPL to display the image, which originates from the data acquisition apparatus DA. A cable connection between the personal computer PC and the data acquisition apparatus DA is not required.

The personal computer PC may subsequently send the image to the video projector VP via the wireless link WL2. The wireless link WL2 may replace, for example, a universal serial bus connection which would otherwise be needed to transfer the image from the personal computer PC to the video projector VP.

The wireless links WL1 and WL2 can be established in a lower frequency band or a higher frequency band. The lower frequency band is substantially comprised between 2.4 and 2.5 GHz. The higher frequency band is substantially comprised between 5.15 and 5.35 GHz. Each of these frequency bands has its advantages and disadvantages. The lower frequency band allows data communication over a greater distance. However, as a result, there is a greater risk of interference due to other wireless links in the same frequency band. What is more, the lower frequency band comprises relatively few channels, which contributes to the risk of interference being relatively great. There is less risk of interference in the higher frequency band, which comprises more channels. However, the higher frequency band is less power efficient and, as a result, can provide data communication over a relatively short distance only.

Preferably, the wireless link WL1 is established in the most appropriate frequency band for a given context. The same applies to the wireless link WL2. To that end, the wireless link module should be able to operate in the lower frequency band and in the higher frequency band. This requires a special design.

Figure 2:
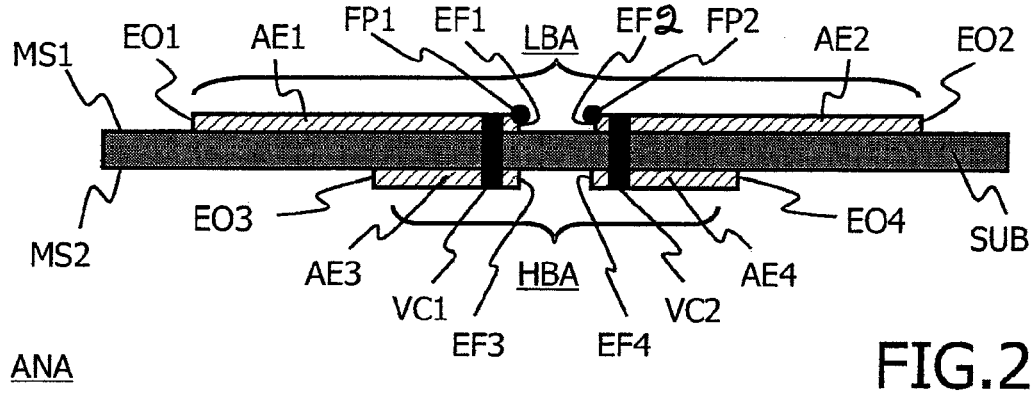
FIG. 2 is a cross section diagram that illustrates an antenna assembly, which forms part of the wireless personal area network.

FIG. 2 illustrates the antenna assembly ANA in a cross section view. The antenna assembly ANA comprises a lower band antenna LBA and a higher band antenna HBA. The lower band antenna LBA lies on a first main surface MS1 of a substrate SUB. The higher band antenna HBA lies on a second main surface MS2 of the substrate SUB, which is parallel with the first main surface MS1. The antenna assembly ANA may be in the form of, for example, the printed circuit board. The substrate SUB may be, for example, a glass epoxy material, which is commonly used for printed circuit boards. The substrate SUB may be, for example, 1.2 millimeters (mm) thick, 15 mm wide and 50 mm long. The lower band antenna LBA and the higher band antenna HBA may be formed by etching copper, which is commonly used for printed circuit boards.

The lower band antenna LBA and the higher band antenna HBA are in the form of half wavelength dipoles. Consequently, lower band antenna LBA has two antenna elements AE1 and AE2, which are substantially symmetrical. The same applies to the higher band antenna HBA, which comprises antenna elements AE3 and AE4. Each antenna element AE1, AE2, AE3, AE4 is in the form of a conductive path that extends from a feeding end EF1, EF2, EF3, EF4 to an open end EO1, EO2, EO3, EO4, respectively. The conductive path is approximately a quarter of a wavelength long. That is, the distance between the feeding end FE and the open end EO of an antenna element AE is substantially a quarter of a wavelength.

The antenna assembly ANA comprises two antenna coupling shorts VC1 and VC2, which electrically couple the lower band antenna LBA and the higher band antenna HBA in parallel. More precisely, antenna coupling short VC1 electrically couples antenna element AE1 of the lower band antenna LBA with antenna element AE3, which is the corresponding antenna element of the higher band antenna HBA. Antenna coupling short VC2 electrically couples antenna element AE2 of the lower band antenna LBA with antenna element AE4, which is the corresponding antenna element of the higher band antenna HBA.

Antenna coupling short VC1 is relatively close to the respective feeding ends EF1 and EF3 of antenna elements AE1 and AE3, respectively. For example, referring to antenna element AE3, the distance between antenna coupling short VC1 and the feeding end EF3 is at least 10 times less than the distance between antenna coupling short VC1 and the open end E03. The same applies to antenna coupling short VC2, which is relatively close to the respective feeding ends EF2 and EF4 of antenna elements AE2 and AE4.

The antenna assembly ANA comprises two feeding points FP1 and FP2. The wireless link circuit WLC is electrically coupled to the antenna assembly ANA, which FIG. 1 illustrates, via the two feeding points FP1 and FP2. That is, in the reception mode, the wireless link circuit WLC takes the radiofrequency signal RF from the two feeding points FP1 and FP2. Conversely, in the transmission mode, the wireless link circuit WLC applies the radiofrequency signal RF to the two feeding points FP1 and FP2.

Figure 3:
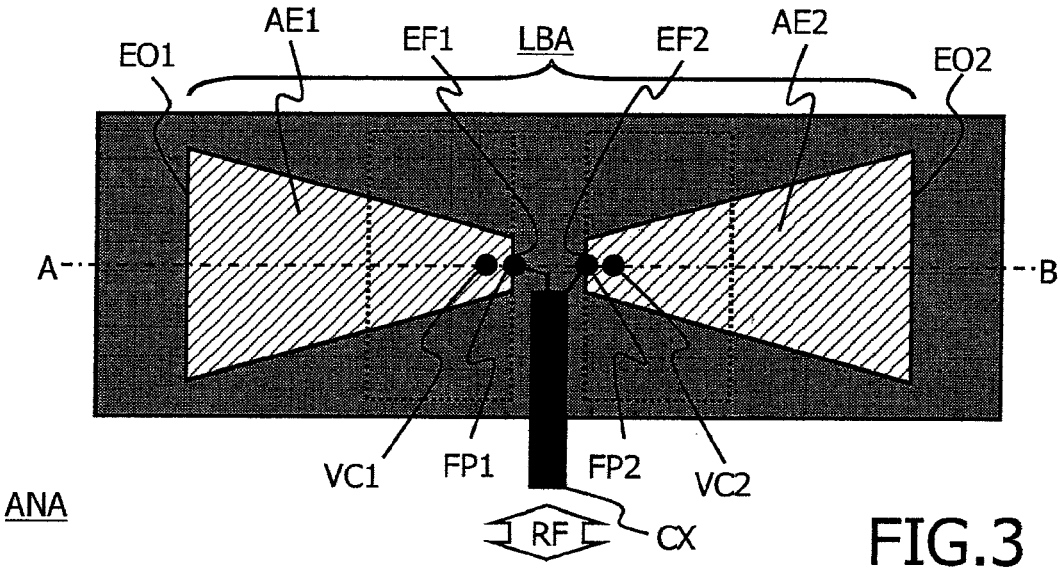
FIG. 3 is a top view diagram that illustrates the antenna assembly viewed towards a first main surface of a substrate that forms part of the antenna assembly.

FIG. 3 illustrates the antenna assembly ANA viewed towards the first main surface MS1 of the substrate SUB. FIG. 3 illustrates a dashed-dotted line A-B along which the cross section that FIG. 2 illustrates is taken. FIG. 3 shows the lower band antenna LBA, which comprises antenna elements AE1 and AE2. These antenna elements have a triangular shape. Antenna element AE1 is relatively narrow at its feeding end FE1 and relatively wide its open end OE1. The same applies to antenna element AE2. This triangular shape allows the lower band antenna LBA to have an appropriate bandwidth.

FIG. 3 illustrates that a coaxial cable CX electrically couples the antenna assembly ANA to the wireless link circuit WLC. The coaxial cable CX has an inner conductor and an outer conductor, which is circular and surrounds the inner conductor. The inner conductor is coupled to feeding point FP1 and, consequently, coupled to antenna element AE1 and, in addition, to antenna element AE3 via the antenna coupling short VC1. The outer conductor is coupled to feeding point FP2 and, consequently, coupled to antenna element AE2 and, in addition, to antenna element AE4 via the antenna coupling short VC2.

FIG. 3 further illustrates antenna elements AE3 and AE4, which lie on the second main surface MS2, in dotted lines as if the substrate SUB were somewhat transparent. There is a substantial overlap between antenna element AE1 of the lower band antenna LBA and antenna element AE3 of the higher band antenna HBA. Consequently, there is a substantial capacitive coupling between antenna elements AE1 and AE3. This capacitive coupling is distributed, as it were, over a significant portion of the respective conductive paths, which form these antenna elements.

For example, let it be assumed that the antenna coupling short VC1 were absent. In that case, antenna element AE1 and antenna element AE3 could be considered as a capacitance. This capacitance has a relatively low impedance at the frequencies of interest. For example, the impedance may be lower than an antenna impedance seen at the feeding points FP1 and FP2 if the antenna assembly ANA were to comprise one antenna only. 50 Ohms and 75 Ohms are typical antenna impedance values. The same applies to antenna elements AE2 and AE4 of the lower band antenna LBA and the higher band antenna HBA, respectively. These antenna elements are also substantially capacitively coupled.

Figure 4:
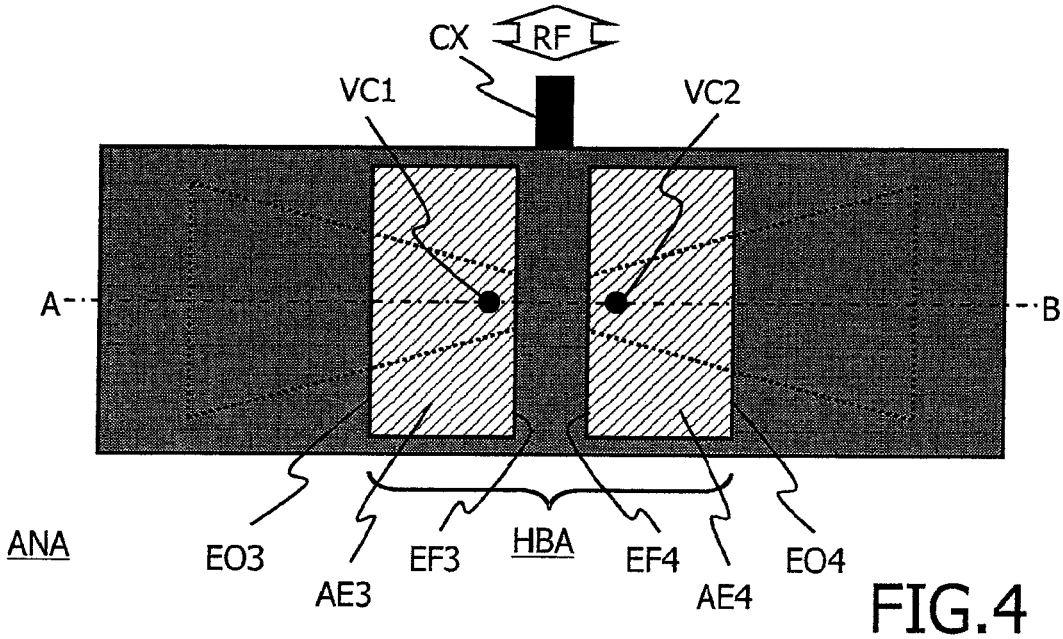
FIG. 4 is a bottom view diagram that illustrates the antenna assembly viewed towards a second main surface of the substrate.

FIG. 4 illustrates the antenna assembly ANA viewed towards the second main surface MS2 of the substrate SUB. That is, one can toggle between the respective views that FIGS. 3 and 4 offer by flipping the antenna assembly ANA along the dashed-dotted line A-B. FIG. 4 shows the higher band antenna HBA, which comprises antenna elements AE3 and AE4. These antenna elements have a rectangular shape, which allows the higher band antenna HBA to have an appropriate bandwidth. Antenna coupling short VC1, which is near the feeding end EF3 of antenna element AE3, electrically couples antenna element AE3 to antenna element AE1 and, in addition, to the wireless link circuit WLC via feeding point FP1 and the inner conductor of the coaxial cable CX. Antenna coupling short VC2, which is near the feeding end EF4 of antenna element AE4, electrically couples antenna element AE4 to antenna element AE2 and, in addition, to the wireless link circuit WLC via feeding point FP2 and the outer conductor of the coaxial cable CX.

Let it be assumed that a 2.45 GHz signal is applied to the antenna assembly ANA, which FIGS. 2, 3, and 4 illustrate. The lower band antenna LBA constitutes a half wavelength dipole at this frequency. The antenna assembly ANA almost behaves as if the lower band antenna LBA were present only. The higher band antenna HBA has no significant influence. Two features account for this behavior. Firstly, the two antenna coupling shorts VC1 and VC2 account for this. As mentioned hereinbefore, antenna coupling short VC1 electrically couples antenna element AE1 and antenna element AE3 and the respective feeding ends EF1 and EF3. Antenna coupling short VC2 electrically couples antenna element AE2 and antenna element AE4 and the respective feeding ends EF2 and EF4. Secondly, there is a substantial capacitive coupling between antenna element AE1 and antenna element AE3. Antenna element AE2 and antenna element AE4 are also substantially capacitively coupled. The higher band antenna HBA has some influence, although not significant, when the 2.45 GHz signal is applied to the antenna assembly ANA. The higher band antenna HBA causes the antenna assembly ANA to have an input impedance at this frequency, which comprises a relatively small capacitive component. This relative small capacitive component does not prevent a good impedance matching with the wireless link circuit WLC, which allows a lossless operation.

Let it be assumed, for the purpose of illustration, that the higher band antenna HBA were not present. In that case, the input impedance at 2.45 GHz will be approximately 75 Ohms. There is substantially no capacitive component, nor an inductive component. The lower band antenna LBA is in resonance. Compared with this case, the higher band antenna HBA introduces a relatively small capacitive component, which is typically at least 10 times less than the resistive component of the input impedance of the antenna assembly ANA at the frequency of interest.

It should be noted that the antenna assembly ANA will also have a capacitive input impedance in a substantial portion of a transitional frequency band from 2.45 GHz to 5.25 GHz, which is due to the presence of the higher band antenna HBA. In many cases, the input impedance will be capacitive in more than half of this transitional frequency band.

Let it now be assumed that a 5.25 GHz signal is applied to the antenna assembly ANA. The higher band antenna HBA constitutes a half wavelength dipole at this frequency. The lower band antenna LBA almost constitutes a full wavelength at this frequency. The lower band antenna LBA constitutes a relatively high impedance when taken in isolation. Consequently, the higher band antenna HBA substantially determines the input impedance of the antenna assembly ANA at 5.25 GHz. The input impedance will be approximately 75 Ohms, which allows a good impedance matching with the wireless link circuit WLC and, as a result, a lossless operation.

However, the lower band antenna LBA plays a significant role from a radiation point of view at 5.25 GHz. This is due to the capacitive coupling between antenna elements AE1 and AE3 and that between antenna elements AE2 and AE4. These respective capacitive couplings cause a current to flow through the lower band antenna LBA when the 5.25 GHz signal is applied to the antenna assembly ANA. As a result, the lower band antenna LBA will radiate an electromagnetic field, which has an impact on the radiation characteristics of the antenna assembly ANA at 5.25 GHz. The two antenna coupling shorts VC1 and VC2 cause the lower band antenna LBA and the higher band antenna HBA to have an equal phase at the respective feeding ends EF1, EF2, EF3, and EF4.

Figure 5:
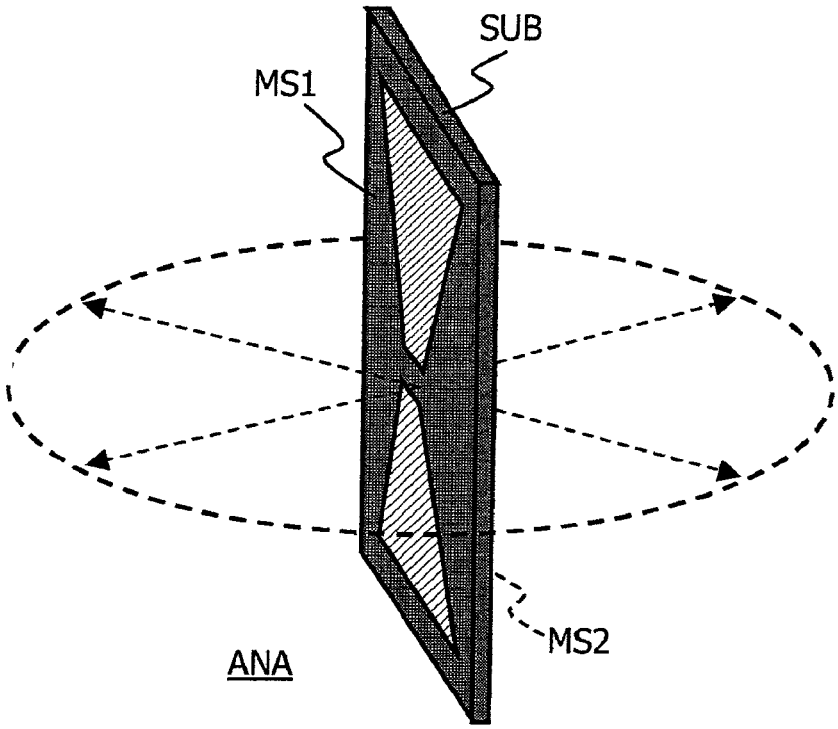
FIG. 5 is a perspective view diagram that illustrates a radiating pattern of the antenna assembly.

FIG. 5 illustrates that the antenna assembly ANA has a radiating pattern, which is substantially omnidirectional, in a plane that is substantially perpendicular to the respective mains surface MS1, MS2 of the substrate SUB. The antenna assembly ANA has such an omnidirectional radiating pattern in the lower frequency band, which is around 2.45 GHz, and in the higher frequency band, which is around 5.25 GHz. The omnidirectional radiating pattern in both frequency bands is achieved thanks to the two antenna coupling shorts VC1 and VC2, on the one hand, and the capacitive coupling between antenna elements AE1 and AE3 and between antenna elements AE2 and AE4, on the other hand. FIG. 2 shows these elements.

What is more, in the higher frequency band, the antenna assembly ANA provides some antenna gain in the plane that FIG. 5 illustrates. The antenna gain is approximately a few decibels (dB). The antenna gain in the higher frequency band may compensate for signal losses in the coaxial cable CX. These signal losses are generally higher in the higher frequency band than in the lower frequency band. The antenna gain allows the wireless link module to generate an electromagnetic field of a given strength with relatively modest signal power from the wireless link circuit WLC. The antenna gain also allows the wireless link module to derive data from a relatively weak electromagnetic field, which emanates from another wireless link module. For those reasons, the antenna assembly ANA allows power efficiency.

Figure 6:
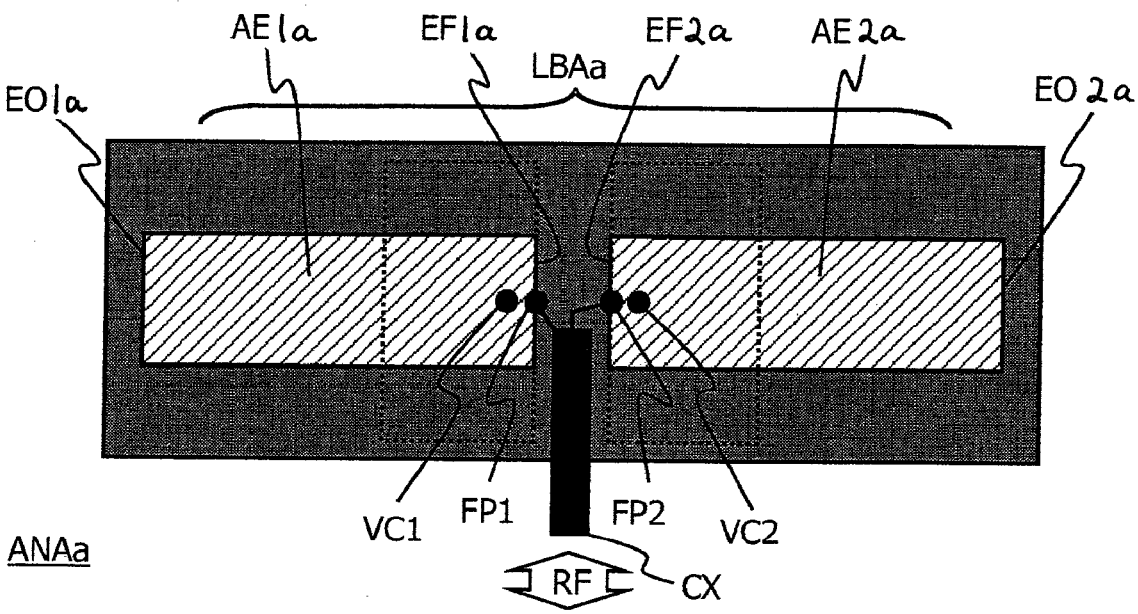
FIG. 6 is a top view diagram that illustrates an alternative antenna assembly.

FIG. 6 illustrates an alternative antenna assembly ANA. The alternative antenna assembly ANA is substantially similar to the antenna assembly ANA that FIGS. 2, 3, and 4 illustrate, except for the lower band antenna LEA. Identical reference signs designate similar entities except for the addition of reference label "a" at ends of appropriate reference signs, which both antenna assemblies comprise. The alternative antenna assembly ANAa comprises an alternative lower band antenna LBAa with two rectangular antenna elements AE1*a* and AE2*a*. Each of these two rectangular antenna elements AE1*a*, AE2*a* has a feeding end EF1*a*, EF2*a* and an open end EO1*a*, EO2*a*, respectively.

The detailed description hereinbefore with reference to the drawings illustrates the following characteristics. A wireless link module (WLM; ANA) comprises a lower band antenna (LBA) and a higher band antenna (HBA). Each of these antennas (LBA, HBA) comprises an antenna element (AE1, AE3) with a feeding end (FE1, FE3) and an open end (CE1, OE3). The respective antenna elements (AE1, AE3) are substantially capacitively coupled. In addition, the respective antenna elements (AE1, AE3) are electrically coupled at the respective feeding ends (FE1, FE3) via an antenna coupling short (VC1). It should be noted that, in the claims, the antenna assembly (ANA), as such, can be considered as a wireless link module. The term "wireless link module" thus covers the wireless link module (WLM) of the detailed description, as well as the antenna assembly (ANA), wherever appropriate.

The detailed description hereinbefore further illustrates the following optional characteristics. Planar conductors that face each other form the respective antenna elements (AE1, AE3), which are substantially capacitively coupled. This allows a capacitive coupling that is distributed over a significant portion of the respective antenna elements, which contributes to a satisfactory radiation pattern.

The detailed description hereinbefore further illustrates the following optional characteristics. The lower band antenna (LBA) is provided on a main surface (MS1) of a substrate (SUB). The higher band antenna (HBA) is provided on another main surface (MS2) of the substrate (SUB). The respective main surfaces (MS1, MS2) face each other. This allows relatively low cost implementations based on, for example, standard printed circuit board technology. What is more, the substrate prevents that disruptive discharges occur between the lower band antenna and the higher band antenna when, for example, a relatively large power signal is applied.

The detailed description hereinbefore further illustrates the following optional characteristics. The lower band antenna (LBA) and the higher band antenna (HBA) each comprise a further antenna element (AE2, AE4) with a feeding end (FE2, FE4) and an open end (OE2, OE4). Accordingly, the lower band antenna (LBA) and the higher band antenna (HBA) each form of dipole. The respective further antenna elements (AE2, AE4) are substantially capacitively coupled. In addition, the respective further antenna elements (AE2, AE4) are electrically coupled at the respective feeding ends (FE2, FE4) via a further antenna coupling short (VC2). This dipole-like implementation allows small sized implementations that provide a satisfactory radiation pattern.

The detailed description hereinbefore further illustrates the following optional characteristics. The antenna element (AE1) of the lower band antenna (LBA) has a triangular shape. The antenna element (AE3) of the higher band antenna (HBA) has a rectangular shape. This allows the lower band antenna and the higher band antenna to have respective appropriate bandwidths.

The aforementioned characteristics can be implemented in numerous different manners. In order to illustrate this, some alternatives are briefly indicated.

The lower band antenna and the higher band antenna may each be a monopole that has a single antenna element and a ground plane. The respective antenna elements, which are substantially capacitively coupled, may have any suitable length. A quarter of a wavelength is merely an example. The respective antenna elements may each be in the form of a rod. The respective rods may be relatively close to each other so as to achieve a substantial capacitive coupling between these rods. Any dielectric material or substance may be placed between the respective antenna elements. This includes air, which has a dielectric constant equal to 1. A flexible insulating material may be used as a substrate, if any. Any suitable conductive material can form the antenna elements. An antenna element may have any shape. For example, a planar antenna element may have a circular or elliptic shape. The shape need not be regular. The lower band antenna and the higher band antenna need not be harmonically related. For example, the frequency bands of interest may have a frequency ratio of 1:1.5.

There are numerous ways of implementing functions by means of items of hardware or software, or both. In this respect, the drawings are very diagrammatic, each representing only one possible embodiment of the invention. Thus, although a drawing shows different functions as different blocks, this by no means excludes that a single item of hardware or software carries out several functions. Nor does it exclude that an assembly of items of hardware or software or both carry out a function.

The remarks made herein before demonstrate that the detailed description with reference to the drawings, illustrate rather than limit the invention. There are numerous alternatives, which fall within the scope of the appended claims. Any reference sign in a claim should not be construed as limiting the claim. The word "comprising" does not exclude the presence of other elements or steps than those listed in a claim. The word "a" or "an" preceding an element or step does not exclude the presence of a plurality of such elements or steps.

The invention claimed is:

1. A wireless link module comprising a lower band antenna and a higher band antenna, each of which comprises an antenna element with a feeding end and an open end, the respective antenna elements being substantially capacitively coupled and being electrically coupled at the respective feeding ends via an antenna coupling short, wherein the coupling short is at a distance from the feeding end.

2. The wireless link module as claimed in claim 1, the respective antenna elements being formed by planar conductors that face each other.

3. The wireless link module as claimed in claim 2, the lower band antenna being provided on a main surface of a substrate, the higher band antenna being provided on another main surface of the substrate, the respective main surfaces facing each other.

4. The wireless link module as claimed in claim 1, the lower band antenna and the higher band antenna each comprising a further antenna element with a feeding end and an open end, so that the lower band antenna and the higher band antenna each form a dipole, the respective further antenna elements being substantially capacitively coupled and being electrically coupled at the respective feeding ends via a further antenna coupling short.

5. The wireless link module as claimed in claim 1, the antenna element of the lower band antenna having a triangular shape, the antenna element of the higher band antenna having a rectangular shape.

6. The wireless link module as claimed in claim 1 comprising a wireless link circuit arranged to process signals in a lower frequency band and in a higher frequency band, the antenna element of the lower band antenna constituting a quarter wavelength radiator for a signal in the lower frequency band, the antenna element of the higher frequency band constituting a quarter wavelength radiator for a signal in the higher frequency band.

7. The wireless link module as claimed in claim 1 comprising a wireless link circuit arranged to process signals in a lower frequency band and in a higher frequency band, the antenna element of the lower band antenna being arranged to operate in the lower frequency band and in a higher frequency band. in a lossless fashion, the lower frequency band and the higher frequency band having a substantially harmonic relationship.

8. A data communication apparatus comprising a wireless link module as claimed in claim 1 for establishing a wireless link with another data communication apparatus.

9. An information rendering apparatus comprising an information rendering arrangement and a wireless link module as claimed in claim 1 for establishing a wireless link with an information providing apparatus, the wireless link module being arranged to apply data, which originates from the information providing apparatus, to the information rendering arrangement so as to render that data.

10. A wireless communication system comprising a plurality of wireless communication apparatuses, at least one of which comprises a wireless link module as claimed in claim 1 for establishing a wireless link with another wireless communication apparatus.

11. A portable X-ray detector comprising a wireless link module as claimed in claim 1.

12. The wireless link module of claim 1, wherein the distance between the coupling short and the feeding end is at least ten times less than a distance between coupling short and the open end.

13. The wireless link module of claim 12, wherein the lower band antenna and the higher band antenna are on opposite sides of a substrate.

* * * * *